US005093933A

United States Patent [19]

Berry

[11] Patent Number: 5,093,933

[45] Date of Patent: Mar. 10, 1992

[54] GLUING GLOVE CONSTRUCTION

[76] Inventor: Carolyn M. Berry, 7202 Enchanted Flame, San Antonio, Tex. 78250

[21] Appl. No.: 715,614

[22] Filed: Jun. 14, 1991

[51] Int. Cl.[5] ..... A41D 19/00

[52] U.S. Cl. ..... 2/161 R; 2/163; 2/21

[58] Field of Search ..... 2/21, 161 R, 163, 159, 2/16, 160, 164; 223/101

[56] References Cited

U.S. PATENT DOCUMENTS

| | | | |
|---|---|---|---|
| 782,517 | 2/1905 | Niebuhr | 2/21 X |
| 1,174,887 | 3/1916 | Meriwether | 2/21 X |
| 3,184,756 | 5/1965 | DeLuca, Jr. | 2/161 R |
| 3,221,344 | 12/1965 | Rokus | 2/161 R |
| 3,386,104 | 6/1968 | Casey | 2/161 R |
| 3,636,568 | 1/1972 | Stuner | 2/161 R |
| 3,732,575 | 5/1973 | Pakulak | 2/161 R |
| 4,272,849 | 6/1981 | Thurston et al. | 2/161 R X |
| 4,873,998 | 10/1989 | Joyner | 2/16 X |
| 4,955,515 | 9/1990 | Brull | 2/21 X |
| 4,995,119 | 2/1991 | Codkind | 2/161 R X |

FOREIGN PATENT DOCUMENTS 0196637 10/1986 European Pat. Off. ..... 2/21

*Primary Examiner*—Werner H. Schroeder
*Assistant Examiner*—Sara M. Current
*Attorney, Agent, or Firm*—Leon Gilden

[57] ABSTRACT

A glove including a body formed with a plurality of finger stalls for receiving the fingers of an individual therewithin. Each finger stall includes a rigid socket positioned within an outer covering of the finger stall, wherein the outer covering is formed of a flame retardant material such as NOMEX®. A rigid cup-shaped socket member is fixedly mounted within each forward terminal end of each stall, with a fabric liner coextensively directed throughout the glove body interiorly thereof within each rigid socket to provide rigid surfaces to secure materials to be glued, as well as providing an outer material to avoid damage to an individual's hand due to exposure to a heated glue gun or an associated glue in a molten state. A modification of the invention includes a ferromagnetic inner socket selectively securing a ferrometallic outer socket that is replaceable in contamination of glue material and the like.

2 Claims, 3 Drawing Sheets

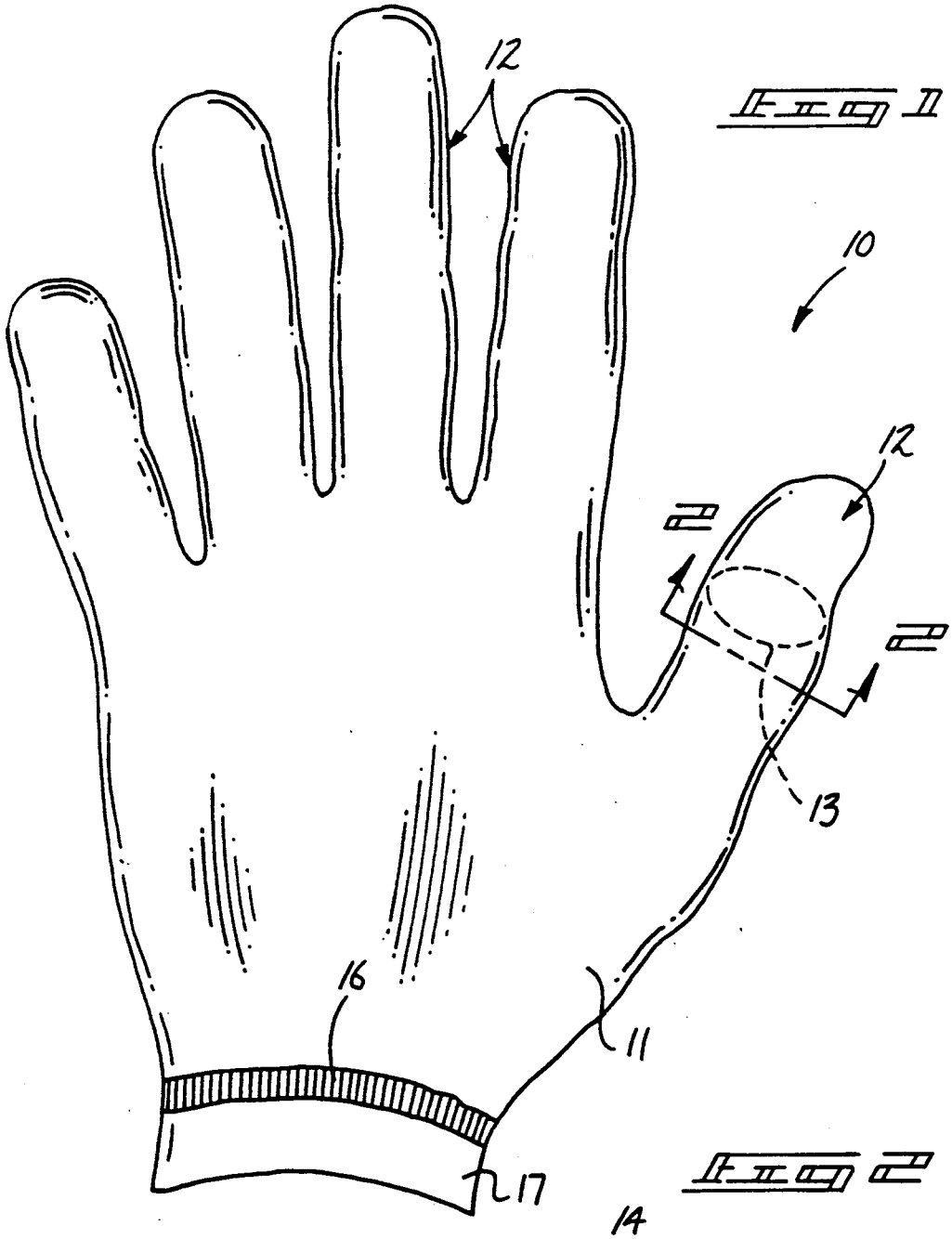
FIG 1
FIG 2
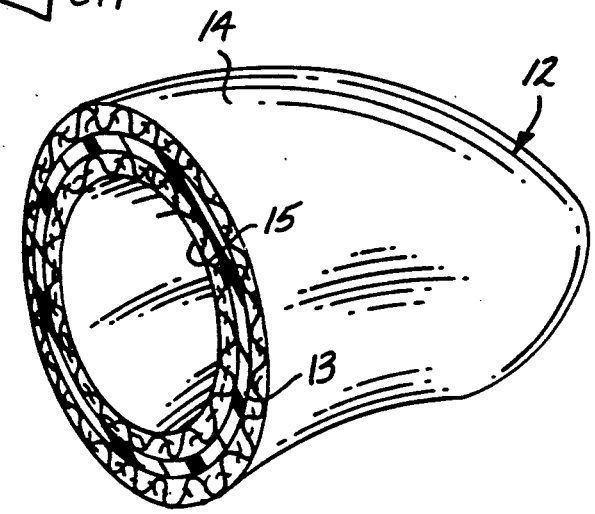

GLUING GLOVE CONSTRUCTION

BACKGROUND OF THE INVENTION

1. Field of the Invention

The field of invention relates to glove construction, and more particularly pertains to a new and improved gluing glove construction wherein the same is formed of a heat retardant material, as well as the rigid inner socket relative to each finger stall to provide clamping surfaces for engagement of workpieces to be glued.

2. Description of the Prior Art

In a gluing procedure, the glove or hand is exposed to elevated temperatures of the glue gun nozzle and associated molten glue. Attendant damage to typical gloves, as well as injury to an individual's hand may readily occur in this manner.

Gloves configured for a variety of purposes are available in the prior art and such specialized gloves are exemplified by U.S. Pat. No. 4,907,297 to Gallucci wherein a glove is provided with slits to accommodate elongate fingernails therethrough at a forward terminal end of each stall.

U.S. Pat. No. 4,590,626 to Chen sets forth a hunting glove wherein a fore finger is provided with a sheath arranged for suitable triggering of a gun in a smooth manner.

U.S. Pat. No. 4,115,873 to Stansbury sets forth a glove formed of a stretchable fabric.

U.S. Pat. No. 4,924,520 to Tagaya sets forth a medical glove construction including a tight fitting section about each finger and a loose fitting central portion to receive the palm surface of the individual's hand therewithin.

As such, it may be appreciated that there continues to be a need for a new and improved gluing glove construction as set forth by the instant invention which addresses both the problems of ease of use as well as effectiveness in construction in accommodating an individual's hands and maintaining them in a safe and secure manner during a gluing procedure.

SUMMARY OF THE INVENTION

In view of the foregoing disadvantages inherent in the known types of glove constructions now present in the prior art, the present invention provides a gluing glove construction wherein the same provides a flame retardant exterior surface with an interior rigid socket positioned within each forward terminal end of each finger stall. As such, the general purpose of the present invention, which will be described subsequently in greater detail, is to provide a new and improved gluing glove construction which has all the advantages of the prior art glove constructions and none of the disadvantages.

To attain this, the present invention provides a glove including a body formed with a plurality of finger stalls for receiving the fingers of an individual therewithin. Each finger stall includes a rigid socket positioned within an outer covering of the finger stall, wherein the outer covering is formed of a flame retardant material such as NOMEX ®. A rigid cup-shaped socket member is fixedly mounted within each forward terminal end of each stall, with a fabric liner coextensively directed throughout the glove body interiorly thereof within each rigid socket to provide rigid surfaces to secure materials to be glued, as well as providing an outer material to avoid damage to an individual's hand due to exposure to a heated glue gun or an associated glue in a molten state. A modification of the invention includes a ferromagnetic inner socket selectively securing a ferrometallic outer socket that is replaceable in contamination of glue material and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gluing glove construction which has all the advantages of the prior art glove constructions and none of the disadvantages.

It is another object of the present invention to provide a new and improved gluing glove construction which may be easily and efficiently manufactured and marketed.

It is a further object of the present invention to provide a new and improved gluing glove construction which is of a durable and reliable construction.

An even further object of the present invention is to provide a new and improved gluing glove construction which is susceptible of a low cost of manufacture with regard to both materials and labor, and which accordingly is then susceptible of low prices of sale to the consuming public, thereby making such gluing glove constructions economically available to the buying public.

Still yet another object of the present invention is to provide a new and improved gluing glove construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top orthographic view of the invention.

FIG. 2 is an orthographic view, taken along the lines 2—2 of FIG. 1 in the direction indicated by the arrows.

DESCRIPTION OF THE PREFERRED EMBODIMENT

Figures 3, 4, 5:
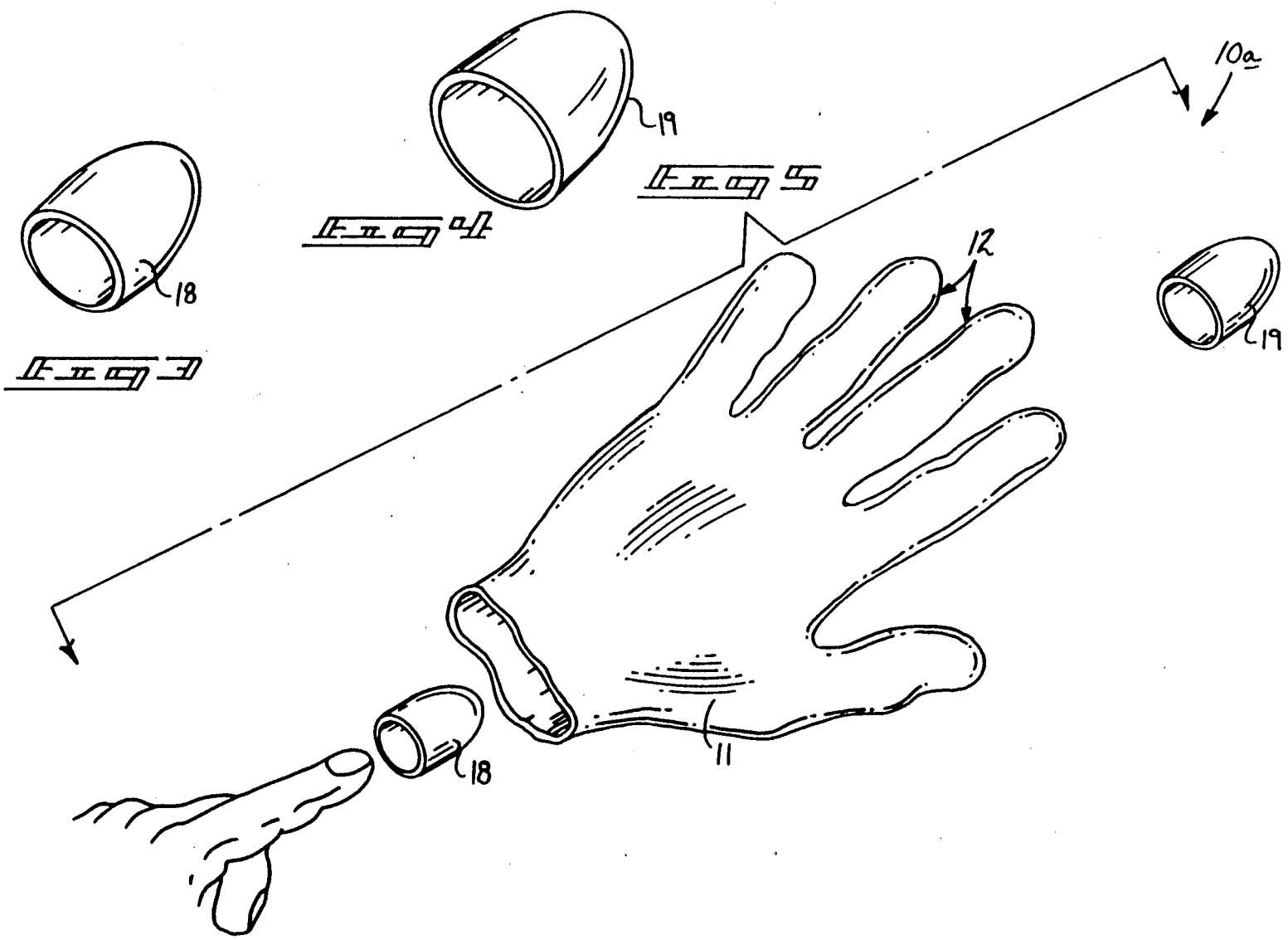
FIG. 3 is an isometric illustration of a rigid socket formed of a ferromagnetic material.
FIG. 4 is an isometric illustration of a metallic exterior socket
FIG. 5 is an isometric illustration, somewhat exploded, of a modification of the invention.
Figure 6:
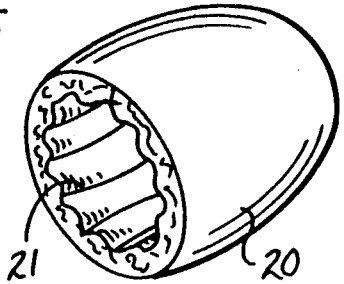
FIG. 6 is an isometric illustration of a third insert utilized for securement within the ferromagnetic first cup socket.

With reference now to the drawings, and in particular to FIGS. 1 to 7 thereof, a new and improved gluing glove construction embodying the principles and concepts of the present invention and generally designated by the reference numeral 10 will be described.

More specifically, the gluing glove construction 10 of the instant invention essentially comprises a glove body 11 including a palm portion defining an internal cavity to receive an individual's hand therewithin, with the glove body 11 including a plurality of finger stalls 12 for receiving each individual finger of an associated hand. The glove is formed of an exterior material defined by a flame retardant material 14, such as NOMEX®. A fabric liner 15 formed of an absorbent material such as cotton is directed coextensively within the flame retardant material 14, wherein each finger stall 12 at a forward terminal end thereof includes a rigid socket 13 captured between the flame retardant material 14 and the fabric liner 15. The finger sockets of each stall are arranged to enhance clamping of parts to be glued, while providing a shield between mold glue and the associated gluing gun from the individual's hands. The socket is to be formed of a metallic or polymeric material. An elastomeric band 16 is formed at a lower terminal end of the glove body 11 about the wrist conduit 17 to enhance securement of the glove relative to an individual's wrist and hand portion.

Figure 7:
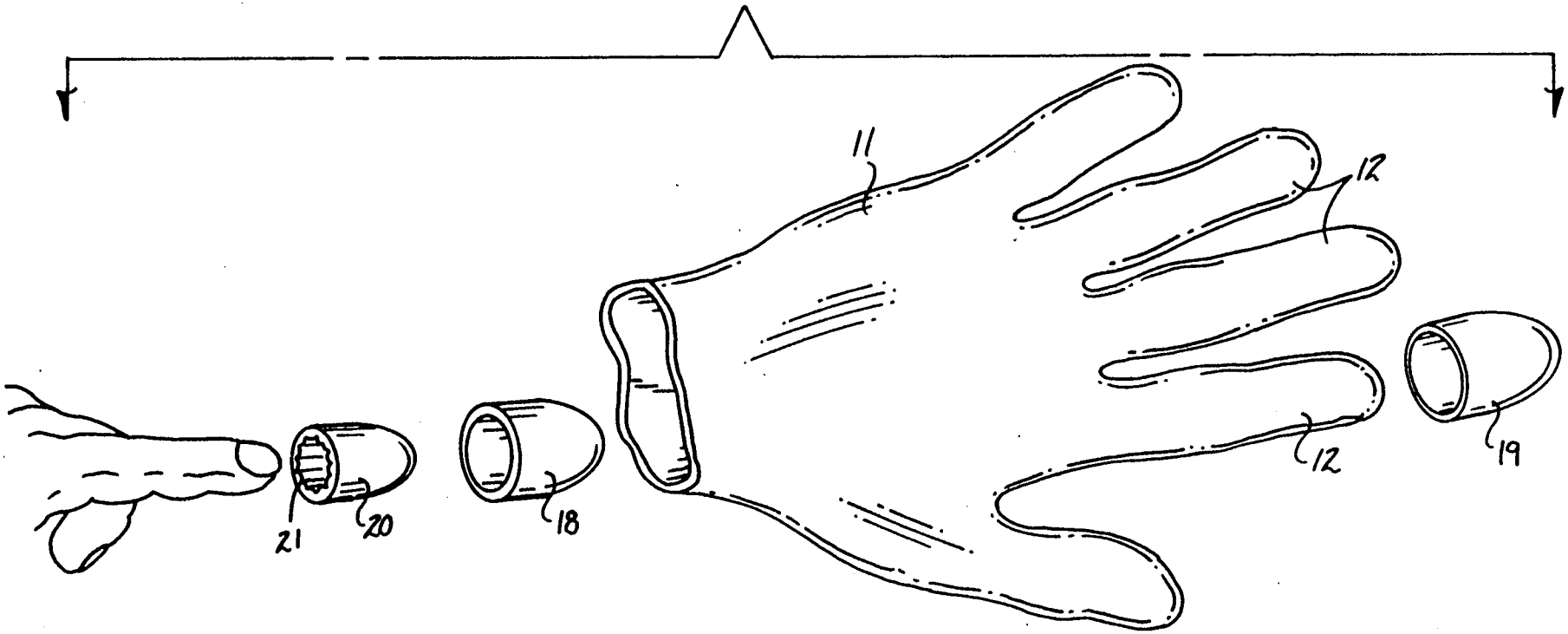
FIG. 7 is an isometric illustration of a modification of the invention utilizing the fluid absorbent insert as illustrated in FIG. 6.

A modification of the invention set forth as the construction 10*a* and as illustrated in FIGS. 3–7 utilizes the glove body 11 formed of the flame retardant material 14 and the coextensive liner of a fluid absorbent material 15, but includes a ferromagnetic first cup socket 18 that is positioned selectively about an individual's finger and projected into an associated finger socket. The ferromagnetic cup socket 18 is complimentarily received within each forward terminal end of each finger socket, wherein each external surface of each finger socket complimentarily receives a ferrometallic second cup socket 19. In this manner, the second sockets are magnetically secured relative to each glove by the first sockets and permit their ease of replacement upon contamination with glue, deformation, and the like in use. If desired, a fluid absorbent third socket 20 is complimentarily received within each first cup socket 18, wherein each third cup socket 20 is formed with a ribbed interior surface 21 defined by parallel ribs to enhance engagement with an individual's finger. The complementary configuration of the second and third sockets 18 and 20 secure the sockets together when projected within each finger socket, as illustrated in FIG. 7 for example.

As to the manner of usage and operation of the instant invention, the same should be apparent from the above disclosure, wherein although one such as a right hand glove as illustrated, it is understood that a mirror image left glove may be provided and the construction of each finger socket, such as illustrated in FIGS. 2, 5, and 7 is duplicated within each finger stall 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A gluing glove constructions, comprising, a glove member including a glove body receiving an individual's hand therewithin, wherein the glove body includes a plurality of finger stalls mounted to the glove body, each finger stall and glove body of the glove member are formed of a flame retardant material, and at least a first cup socket is mounted selectively within each forward terminal end of each finger stall, wherein each first cup socket is formed of a rigid material, and wherein the first cup socket is formed of ferromagnetic magnetic material and is complimentarily received selectively within a respective finger socket at a forward terminal end thereof, and including a ferrometallic second cup socket securable about the respective finger socket to an exterior surface thereof in magnetic communication with the first cup socket.

2. A glove construction as set forth in claim 1, including a fluid absorbent third cup socket complimentarily received within the first cup socket, the third cup socket including a ribbed interior surface defined by parallel ribs to enhance securement of an individual's finger therewithin.

* * * * *